US008740171B2

(12) United States Patent
Crescenzo

(10) Patent No.: US 8,740,171 B2
(45) Date of Patent: Jun. 3, 2014

(54) HANGING SYSTEM FOR PICTURES OR OBJECTS

(76) Inventor: Philip J. Crescenzo, Buena, NJ (US)

( * ) Notice: Subject to any disclaimer, the term of this patent is extended or adjusted under 35 U.S.C. 154(b) by 0 days.

(21) Appl. No.: 13/193,067

(22) Filed: Jul. 28, 2011

(65) Prior Publication Data

US 2013/0026319 A1 Jan. 31, 2013

(51) Int. Cl.

| | |
|---|---|
| ***A47G 1/24*** | (2006.01) |
| ***B60R 1/02*** | (2006.01) |
| ***A47G 1/16*** | (2006.01) |
| *A47G 1/17* | (2006.01) |

(52) U.S. Cl.
CPC .... *A47G 1/16* (2013.01); *A47G 1/17* (2013.01)
USPC ..... 248/476; 248/475.1; 248/489; 248/546

(58) Field of Classification Search
CPC ..... A47G 1/16; A47G 1/22; A47G 1/17; A47G 1/1606
USPC ..... 248/467, 682, 683, 475.1, 489, 684, 248/476
See application file for complete search history.

(56) References Cited

U.S. PATENT DOCUMENTS

| | | | | |
|---|---|---|---|---|
| 1,023,502 | A | 4/1912 | Callanan | |
| 1,297,584 | A | 3/1919 | Mock | |
| 1,883,834 | A * | 10/1932 | Turner | 248/494 |
| 3,300,173 | A * | 1/1967 | Kennedy, Jr. | 248/467 |
| 3,551,939 | A * | 1/1971 | Rager | 16/10 |
| 3,858,269 | A * | 1/1975 | Sutton et al. | 16/16 |
| 4,083,525 | A | 4/1978 | Rath | |
| 4,226,394 | A | 10/1980 | Einhorn | |
| 4,566,665 | A * | 1/1986 | Rynearson | 248/495 |
| 4,637,583 | A | 1/1987 | Babitz | |
| 4,858,351 | A | 8/1989 | Sewell et al. | |
| 4,970,754 | A * | 11/1990 | Anderson et al. | 16/16 |
| 5,015,118 | A | 5/1991 | Sewell et al. | |
| 5,328,139 | A | 7/1994 | Barnes | |
| 5,409,489 | A | 4/1995 | Sioufi | |
| 5,454,542 | A | 10/1995 | Hart | |
| 5,588,629 | A | 12/1996 | Barnes | |
| 5,605,313 | A | 2/1997 | Erickson et al. | |
| 5,794,901 | A | 8/1998 | Sigel | |
| D402,183 | S | 12/1998 | Bellehumeur | |
| 6,042,078 | A | 3/2000 | Donovan | |
| 6,095,478 | A | 8/2000 | Barnes | |
| 6,126,126 | A * | 10/2000 | McKiernan, Jr. | 248/217.3 |

(Continued)

FOREIGN PATENT DOCUMENTS

| | | |
|---|---|---|
| GB | 2 333 820 | 8/1999 |

OTHER PUBLICATIONS www.ooks.com; Framestraight pins; internet; date unknown.
Copending, U.S. Appl. No. 13/681,615, filed Nov. 20, 2012.

(Continued)

*Primary Examiner* — Amy Sterling
(74) *Attorney, Agent, or Firm* — Cohen & Hildebrand, PLLC

(57) ABSTRACT

A hanging system having a panel with a front and back surface, wherein an adhesive component is on the front surface, and a pin on the back surface, the pin extends outwardly from the back surface at an angle with respect to the back surface, the angle being between about 50 to 80 degrees, the pin has an outer end, wherein the outer end is pointed so as to allow for a puncturing effect when pressed into a wall material.

22 Claims, 3 Drawing Sheets

(56) References Cited

U.S. PATENT DOCUMENTS

| | | | | |
|---|---|---|---|---|
| 6,186,466 | B1 | 2/2001 | Baird et al. | |
| 6,206,334 | B1 | 3/2001 | Weck et al. | |
| 6,439,520 | B1 | 8/2002 | Johnson | |
| 6,471,169 | B1 * | 10/2002 | Maloney | 248/205.3 |
| 6,484,996 | B2 | 11/2002 | Astell | |
| 6,708,367 | B2 * | 3/2004 | Billson | 16/16 |
| 6,840,489 | B2 | 1/2005 | Barnes | |
| 6,957,717 | B1 | 10/2005 | White et al. | |
| 6,962,016 | B1 | 11/2005 | Meyer | |
| 7,249,624 | B2 | 7/2007 | Zeh et al. | |
| D572,122 | S | 7/2008 | Cave | |
| 7,431,258 | B2 | 10/2008 | Lamotta | |
| 7,497,028 | B2 * | 3/2009 | Nevers et al. | 33/613 |
| 7,891,616 | B2 * | 2/2011 | Pinchuk et al. | 248/206.5 |
| 2006/0282981 | A1 * | 12/2006 | Speck et al. | 16/16 |
| 2007/0194191 | A1 | 8/2007 | Persson | |

OTHER PUBLICATIONS

Copending, U.S. Appl. No. 13/846,416, filed Mar. 18, 2013.

PCT International Search Report and Written Opinion in connection with counterpart PCT International Patent Application Serial No. PCT/US2012/040444 (Aug. 27, 2012)(8 pages).

* cited by examiner

Isometric In Use

Isometric Back

Back View

Isometric Front

Cross Section

HANGING SYSTEM FOR PICTURES OR OBJECTS

FIELD OF THE INVENTION

The present invention is directed to a means of hanging objects such as pictures, clocks, mirrors, or the like.

BACKGROUND OF THE INVENTION

Many methods of hanging pictures are not stable or are not effective. The present invention features a novel hanging system for hanging pictures, clocks, or other objects. The system of the present invention helps to keep the object level, stable, and flush with the wall. The system allows for easy removal and hanging of the object. The present invention it not limited to use with clocks, mirrors, or pictures.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
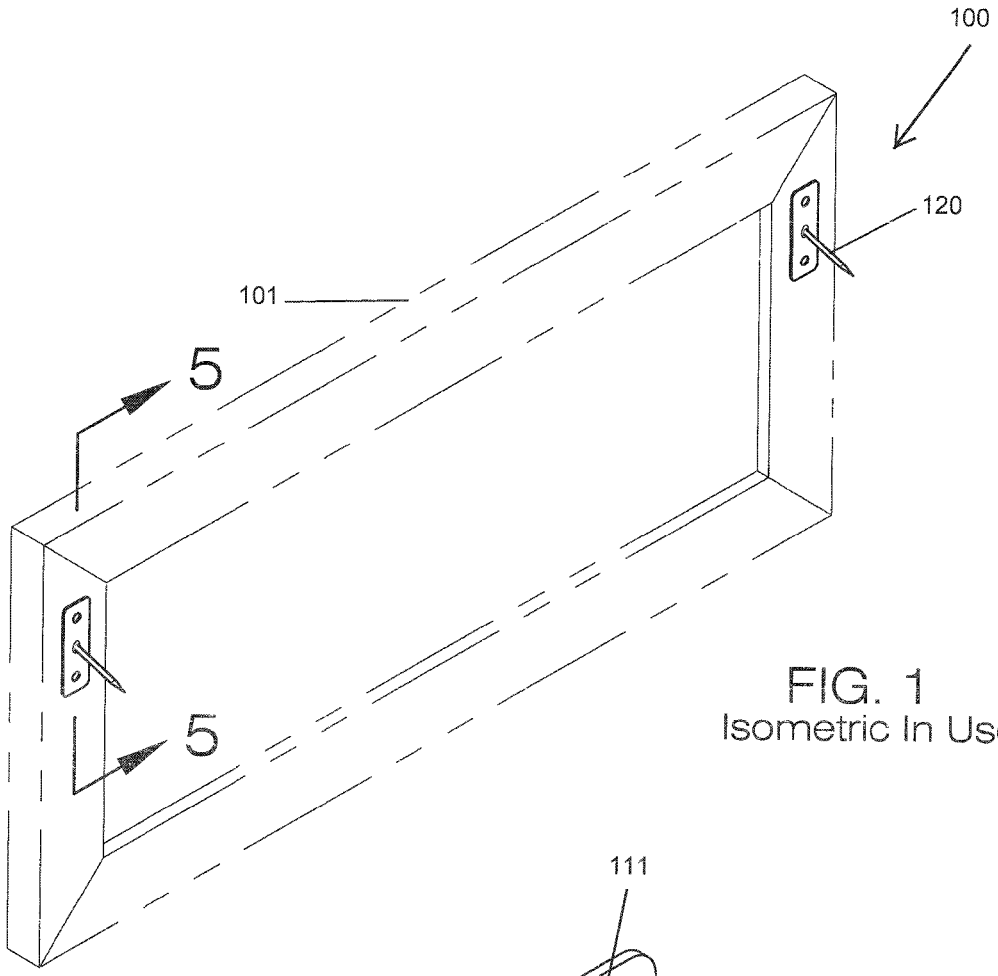
FIG. 1 is a perspective view of the hanging system of the present invention.
Figure 2:
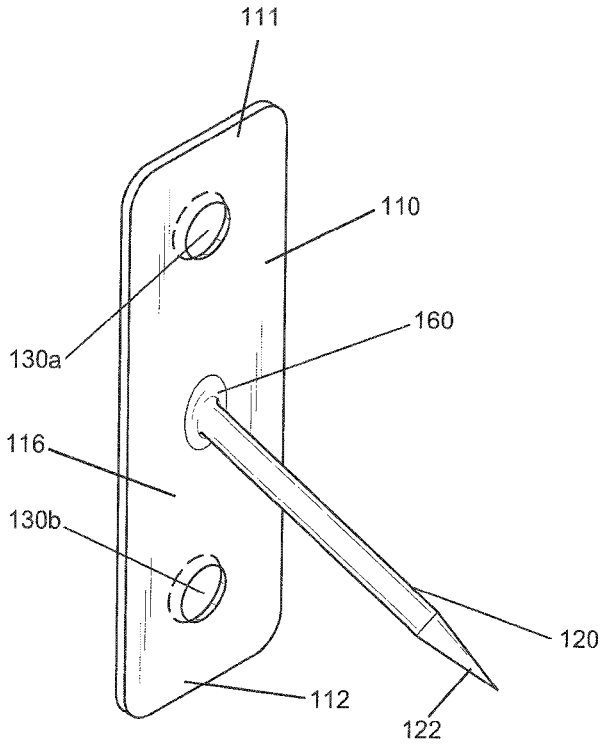
FIG. 2 is a back view of the hanging system of the present invention.
Figure 4:
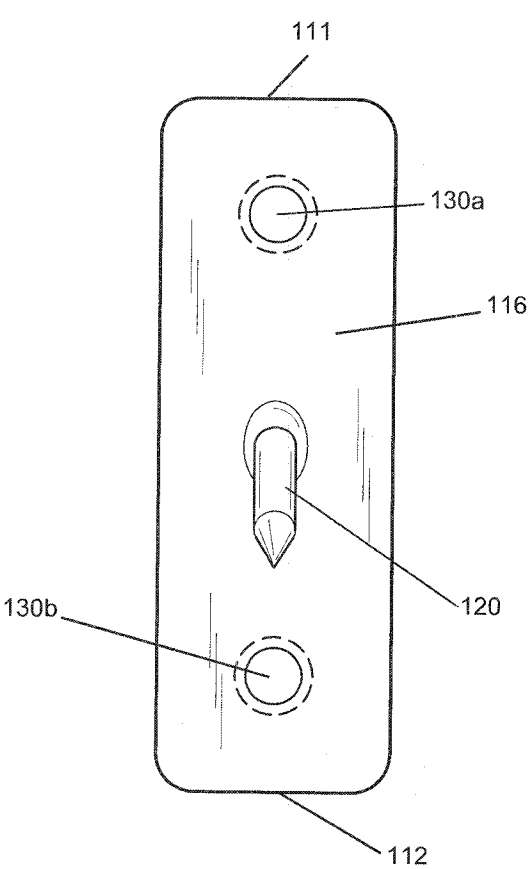
FIG. 4 is another back view of the hanging system of the present invention.
Figure 3:
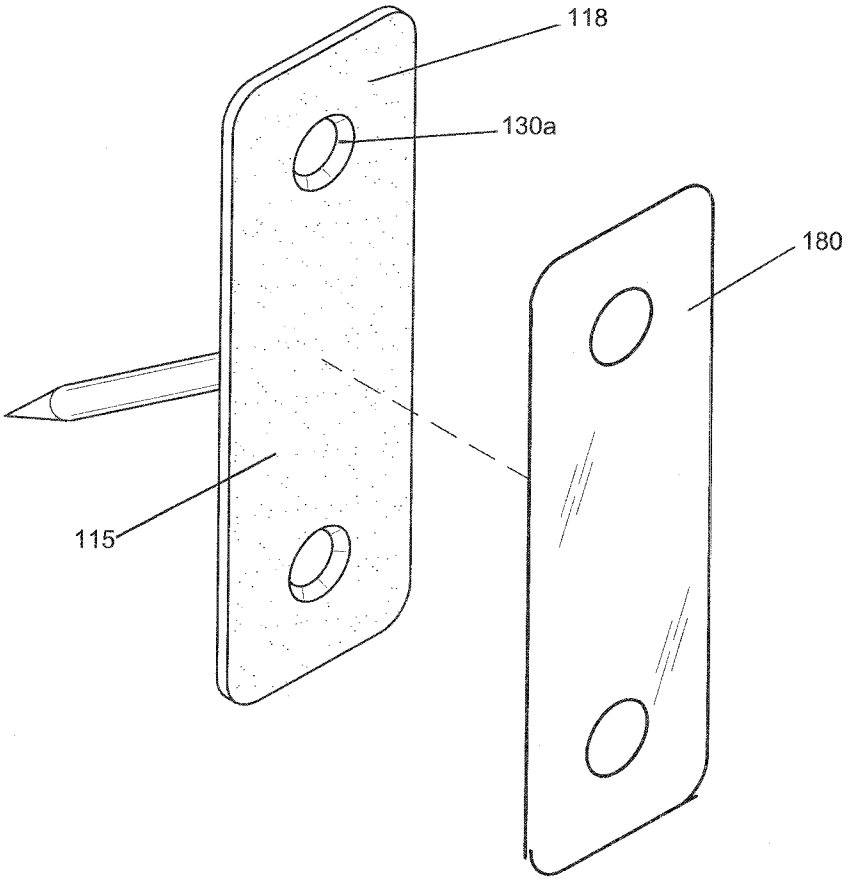
FIG. 3 is a front view of the hanging system of the present invention.
Figure 5:
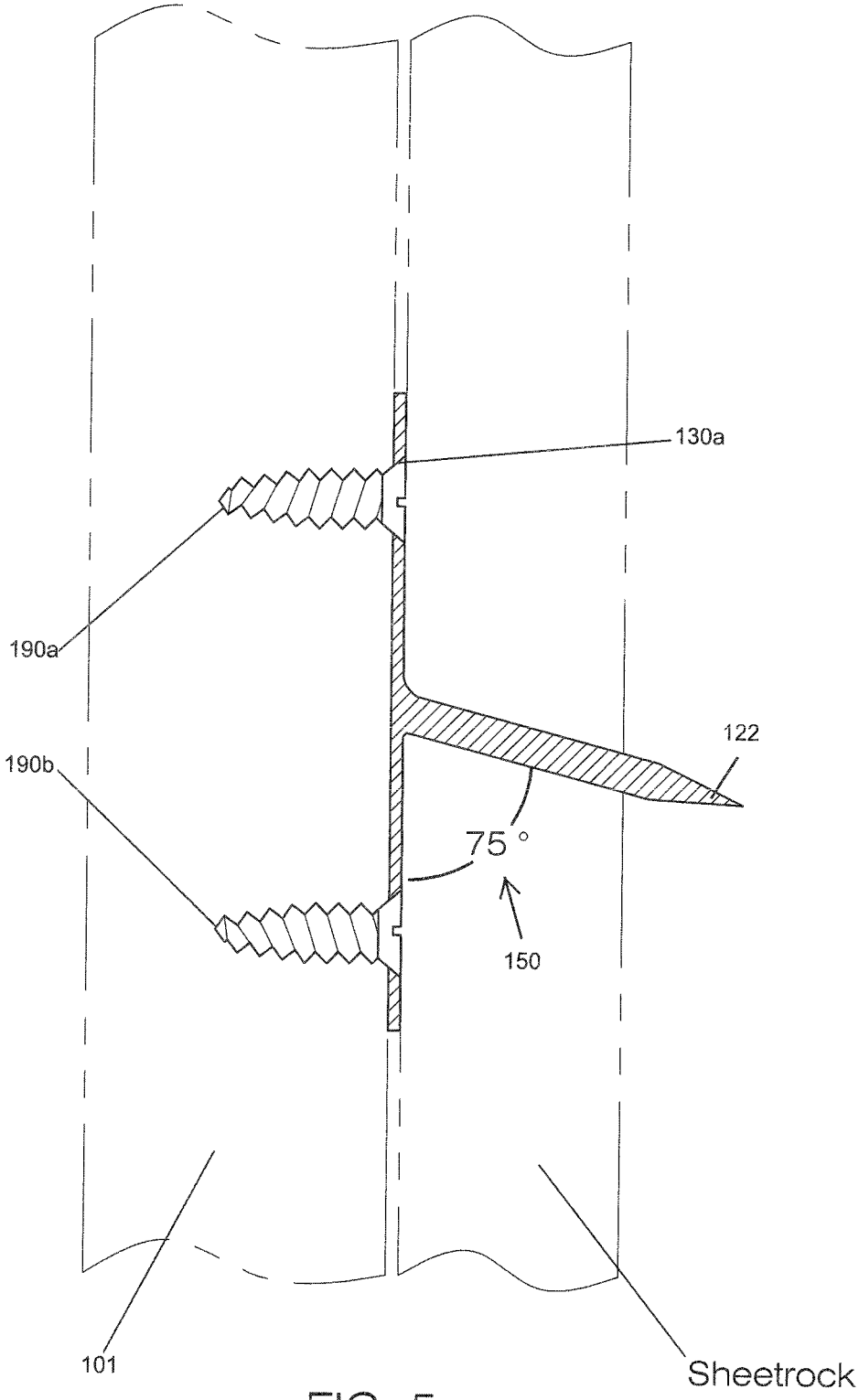
FIG. 5 is a cross-sectional view of FIG. 1 of the hanging system of the present invention.

Referring now to FIG. 1-5, the present invention features a novel hanging system 100 for hanging pictures, clocks, or other objects. In some embodiments, the system 100 comprises a panel 110 having a first end 111 (e.g., top end), a second end 112 (e.g., bottom end), a front surface 115, and a back surface 116. The panel 110 may be generally flat. In some embodiments, the panel 110 is elongated. The panel 110 may be constructed in a variety of sizes (and shapes). For example, in some embodiments, the panel 110 is between about 1 to 3 inches in length as measured from the first end 111 to the second end 112. In some embodiments, the panel 110 is about 2.5 inches in length as measured from the first end 111 to the second end 112. In some embodiments, the panel 110 is between about 3 to 5 inches in length as measured from the first end 111 to the second end 112. The present invention is not limited to the aforementioned dimensions.

An adhesive component 118 is disposed on the front surface 115 of the panel 110. The adhesive component 118 allows the panel 110 to be mounted to the object (e.g., see FIG. 1, wherein two systems 100 are mounted to the back of a picture frame 101). Adhesive components (e.g., temporary, permanent, etc.) are well known to one of ordinary skill in the art.

In some embodiments, a removable backing 180 is removably attached to the adhesive 118. The removable backing 180 functions to protect the adhesive 118 prior to use. Removable backings 180 are well known to one of ordinary skill in the art.

A pin 120 is disposed on the back surface 116 of the panel 110. The pin 120 extends outwardly from the back surface 116 at an angle 150 with respect to the back surface 116 (e.g., see FIG. 5). The pin 120 has an outer end 122, wherein the outer end 122 is pointed so as to allow for a puncturing effect when pressed into a wall material. The angle 150 helps draw the object flush with the wall.

In some embodiments, the angle 150 is about 75 degrees. In some embodiments, the angle 150 is between about 50 to 80 degrees. In some embodiments, the angle 150 is between about 60 to 80 degrees. In some embodiments, the angle 150 is between about 70 to 80 degrees. In some embodiments, the angle 150 is between about 70 to 75 degrees.

A first aperture **130*a* and a second aperture 130*b* are disposed in the panel 110. In some embodiments, the first aperture 130*a* is positioned at or near a first end 111 of the panel 110. In some embodiments, the second aperture 130*b* is positioned at or near a second end 112 of the panel 110. In some embodiments, the apertures 130*a*, 130*b* comprise countersunk holes. Countersunk holes are well known to one of ordinary skill in the art. The countersunk holes allow for a screw 190 to be threaded through the apertures and the head of the screw 190 to remain flush with the back surface 116 of the panel 110**.

In some embodiments, the system 100 comprises a first screw **190*a* adapted to engage the first aperture 130*a*. In some embodiments, the system 100 comprises a second screw 190*b* adapted to engage the second aperture 130*b***.

In some embodiments, the system 100 further comprises a reinforcement component 160 disposed at an intersection of the pin 120 and the back surface 116 of the panel 110. The reinforcement component 160 functions to help secure the pin 120 to the panel 110.

To use the system 100 of the present invention to hang an object (e.g., a picture frame 101), a user first peels off the removable backing 180 from the adhesive 118. The adhesive 118 is stuck to the object (e.g., see FIG. 1). Optionally (e.g., for a heavy object), a user can insert screws 190 into the aperture 130 to further secure the panel 110 to the object. Next, a user presses the pins 120 into the wall until the pins 120 puncture the wall and the object is secured in place.

The present invention also features a kit comprising two or more hanging systems 100 as described above. In some embodiments, the kit further comprises screws 190. In some embodiments, the kit comprises four hanging systems. In some embodiments, the kit comprises six hanging systems. In some embodiments, the kit comprises ten hanging systems.

In some embodiments, the system 100 is designed in three grades, a first grade for small objects, a second grade for medium objects, and a third grade for large objects.

In some embodiments, the system 100 can mount an object of at least 1 pound. In some embodiments, the system 100 can mount an object of at least 5 pounds. In some embodiments, the system 100 can mount an object of at least 10 pounds. In some embodiments, the system 100 can mount an object of at least 25 pounds. In some embodiments, the system 100 can mount an object of at least 50 pounds. In some embodiments, the system 100 can mount an object of at least 100 pounds.

As used herein, the term "about" refers to plus or minus 10% of the referenced number. For example, an embodiment wherein the panel 110 is about 2 inches in length includes a panel 110 that is between 0.8 and 2.2 inches in length.

The disclosures of the following U.S. patents are incorporated in their entirety by reference herein: U.S. Pat. No. 4,083, 535; U.S. Pat. No. 4,637,583; U.S. Pat. No. 5,605,313; U.S. Pat. No. 6,206,334; U.S. Pat. No. 6,962,016; U.S. Design Pat. No. D572122.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A hanging system comprising: a panel having a front surface and a back surface and only a single pin non-moveably disposed on the back surface of the panel prior to being mounted, the pin extends outwardly from and in direct physical contact with the back surface at an angle with respect to the back surface without extending beyond the front surface of the panel, the angle being between about 50 to 80 degrees, the pin has an outer end, wherein the outer end is pointed so as to allow for a puncturing effect when pressed into a wall material, the pin being neither struck nor stamped from the panel while having a substantially uniform circular cross section extending from proximate its pointed outer end to proximate where the pin contacts the back surface of the panel; and the back surface of the panel being substantially planar; other than the single pin disposed at the angle between about 50 to 80 degrees nothing else of the hanging system protrudes beyond the back surface of the panel; at least one fastener securing an object to be hung in direct contact with and completely covering the front surface of the panel, wherein the fastener is an adhesive component or at least one screw receivable from the back surface and extending out beyond the front surface of the panel via at least one aperture defined therethrough.

2. The system of claim 1, wherein the at least one aperture includes a first aperture disposed in the panel.

3. The system of claim 2, wherein the first aperture is positioned at or near a first end of the panel.

4. The system of claim 3, wherein the first aperture comprises a countersunk hole.

5. The system of claim 2, wherein the at least one aperture further includes a second aperture disposed in the panel.

6. The system of claim 5, wherein the second aperture is positioned at or near a second end of the panel.

7. The system of claim 5, wherein the second aperture comprises a countersunk hole.

8. The system of claim 1, further comprising a reinforcement component non-moveably disposed at an intersection of the pin and the back surface of the panel prior to being mounted, the reinforcement component functions to help secure the pin to the panel.

9. The system of claim 1, further comprising a removable backing removably attached to g adhesive component disposed on the front surface of the panel, the removable backing functions to protect the adhesive component prior to use.

10. The system of claim 2, wherein the at least one screw includes a first screw adapted to engage the first aperture.

11. The system of claim 5, wherein the at least one screw includes a second screw adapted to engage the second aperture.

12. The system of claim 1, wherein the system is a kit having two or more hanging systems.

13. The system of claim 12, wherein the at least one aperture includes a first aperture and a second aperture each disposed in the panel.

14. The system of claim 13, wherein the first aperture and the second aperture each comprise a countersunk hole.

15. The system of claim 12, wherein a reinforcement component is non-moveably disposed at an intersection of the pin and the back surface of the panel, the reinforcement component functions to help secure the pin to the panel prior to being mounted.

16. The system of claim 12, wherein a removable backing is removably attached to the adhesive component disposed on the front surface of the panel, the removable backing functions to protect the adhesive component prior to use.

17. The system of claim 13, wherein the at least one screw includes screws adapted to engage the apertures.

18. A method for using the hanging system of claim 1 to hang an object on a wall, the method comprising the steps of:

orienting the hanging system so that the back surface of the panel is facing the wall and the pin is pointing downwards;

puncturing the wall with the pin; and pushing the front surface of the panel until the back surface of the panel is in contact with the wall.

19. The method in accordance with claim 18, wherein prior to the orienting step, further comprising the step of securing the front surface of the panel to the object.

20. The method in accordance with claim 19, wherein the securing step comprises adhering an adhesive component disposed on the front surface of the panel to the object.

21. The method in accordance with claim 19, wherein the securing step comprises fastening the front surface of the panel to the object using at least one screw received within an aperture defined through the panel.

22. The system of claim 1, wherein the angle is about 75 degrees.

* * * * *